United States Patent [19]

Budzich

[11] 4,290,449

[45] * Sep. 22, 1981

[54] LOAD RESPONSIVE CONTROL VALVE

[76] Inventor: Tadeusz Budzich, 80 Murwood Dr., Moreland Hills, Ohio 44022

[ * ] Notice: The portion of the term of this patent subsequent to Apr. 29, 1997, has been disclaimed.

[21] Appl. No.: 96,803

[22] Filed: Nov. 23, 1979

Related U.S. Application Data

[63] Continuation-in-part of Ser. No. 960,072, Nov. 13, 1978, Pat. No. 4,200,118.

[51] Int. Cl.[3] ..... F15B 13/08

[52] U.S. Cl. ..... 137/596.13; 60/427; 91/436; 91/464; 137/625.69

[58] Field of Search ..... 60/427; 91/436, 464; 137/596.13, 625.69

[56] References Cited

U.S. PATENT DOCUMENTS 4,200,118 4/1980 Budzich ..... 137/596.13

*Primary Examiner*—Gerald A. Michalsky

[57] ABSTRACT

A load responsive flow control valve for use in a system controlling a plurality of loads. The system is powered by a single fixed displacement pump equipped with a load responsive bypass valve or a variable displacement pump equipped with load responsive control, which during simultaneous control of multiple loads automatically maintains the pump discharge pressure at a level higher by a constant pressure differential than the pressure required by largest load being controlled. The load responsive valve is of a four position regeneration type which in the regeneration position while connecting together both of the load chambers supplies irrespective of the pressure level an adjustable controlled flow into those chambers from the inlet chamber through a metering orifice.

6 Claims, 1 Drawing Figure

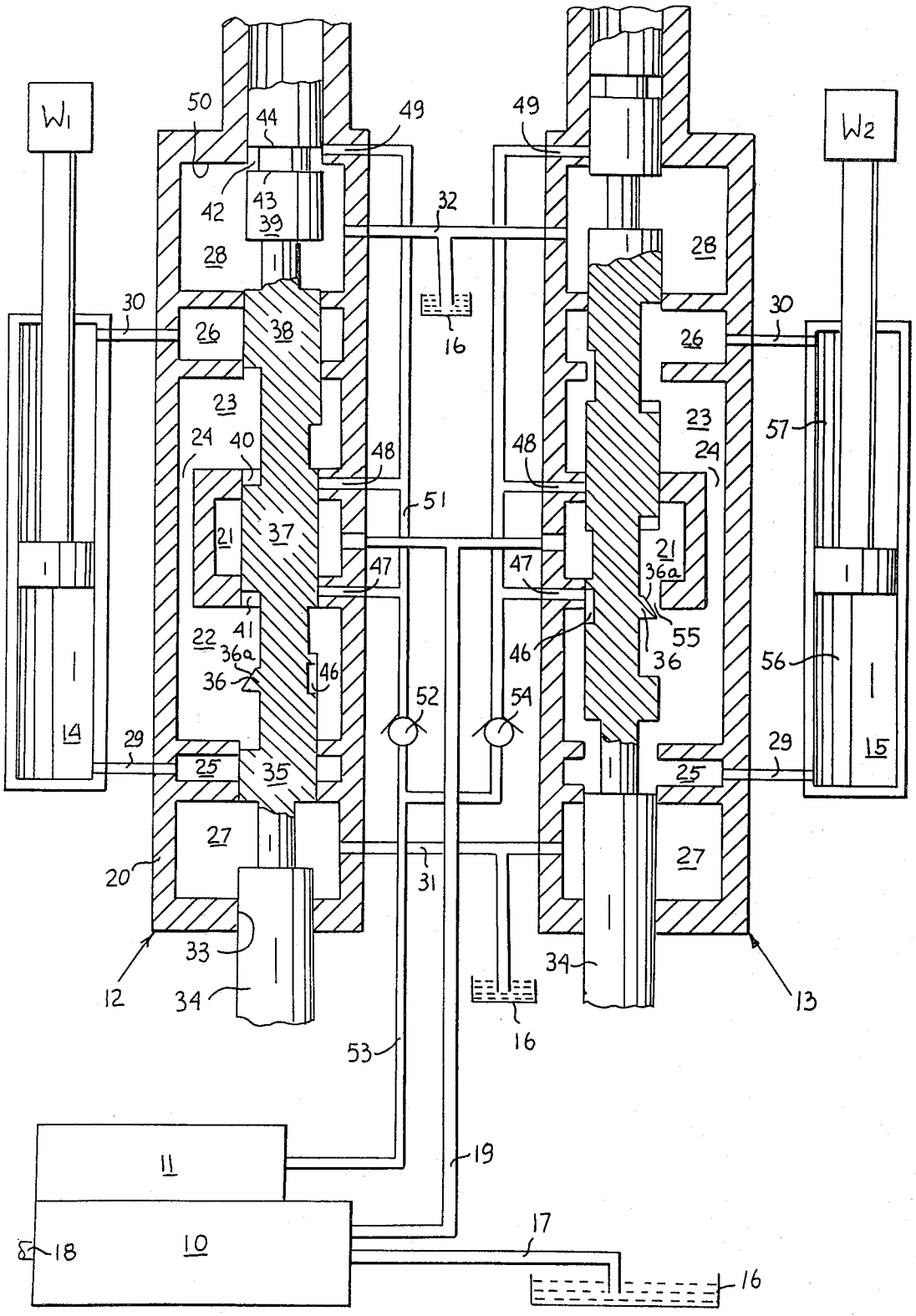
W1
W2
50
44
49
49
42
43
39
32
28
28
30
26
38
16
26
30
23
24
40
48
48
23
24
57
51
21
37
21
36a
47
47
22
41
36a
36
46
46
55
36
56
52
54
14
29
25
35
25
29
15
27
27
20
31
33
34
34
12
13
16
53
11
19
10
18
17
16

LOAD RESPONSIVE CONTROL VALVE

This application is a continuation in part of application Ser. No. 960,072, filed Nov. 13, 1978, for "Load Responsive Control Valve", now U.S. Pat. No. 4,200,118.

BACKGROUND OF THE INVENTION

This invention relates generally to pressure compensated load responsive control valves of direction control type, which in control of a load, while using a control load pressure sensing passage, automatically maintain pump discharge pressure at a level higher, by a constant pressure differential, than the pressure required by the controlled load, by either bypassing excess pump flow to system reservoir, or by varying displacement of the pump.

In more particular aspects this invention relates to load responsive direction control valves having load sensing ports and a control regeneration position, in which the motor ports are connected to each other and to system pump.

In still more particular aspects this invention relates to load responsive direction control valves having load sensing ports and a control regeneration position in which the flow into connected motor ports is controlled proportionally to the displacement of spool in its regenerative position and independent of system pressure.

The direction control valves with regeneration position, in which motor ports are connected to each other and to system pump, while system reservoir is isolated, are well known in the art and have been used in conventional fluid power circuits for many years. Those valves in the regeneration position permit the free fluid transfer between, for example, piston rod end and piston end of a hydraulic cylinder. The pump then supplies only the difference between flow in and flow out of a cylinder. In this way a very much faster extension of the cylinder is achieved than that equivalent to supplying all of the pump flow into the inlet port of the cylinder. Those valves suffer from one basic disadvantage in that all of the pump flow has to be used in regeneration cycle, thus limiting the choice of maximum cylinder speed and preventing control of the cylinder speed.

SUMMARY OF THE INVENTION

It is therefore a principal object of this invention to control in a load responsive system the quantity of fluid delivered from the system pump into regeneration circuit, thus permitting control of the speed of a cylinder irrespective of system pressure.

Another object of this invention is to provide a regeneration circuit, in which only a selected portion of the total pump flow is used in regeneration, the rest of the pump flow being available to perform other system functions.

Briefly the foregoing and other additional objects and advantages of this invention are accomplished by providing in a load sensing circuit a load responsive regeneration type valve with a feature of connecting, in regenerating position, both cylinder ports through a variable metering orifice with the system pump, while connecting the load sensing port to both cylinder ports.

DESCRIPTION OF THE DRAWING

The single drawing shows diagramatically sections through two identical four position load responsive direction control valves with actuators, pump and other system components shown diagramatically.

DESCRIPTION OF THE PREFERRED EMBODIMENT

Referring now to the drawing the hydraulic system shown therein comprises a fluid pump 10, equipped with a flow control 11, which regulates delivery of the pump 10 into a load responsive circuit, composed of identical direction control valve assemblies, generally designated as 12 and 13, controlling actuators 14 and 15 subjected to loads $W_1$ and $W_2$. The pump 10 may be of fixed or variable displacement type. With the pump 10 being of fixed displacement type the flow control 11, in a well known manner, regulates delivery from the pump to load responsive circuit by bypassing part of the pump flow to a system reservoir 16. With the pump 10 being of variable displacement type the flow control 11, in a well known manner, regulates delivery from the pump 10 to load responsive circuit by changing the pump displacement. Although in the drawing, for purposes of demonstration of the principle of the invention, direction control valve assemblies 12 and 13 are shown separated and the flow control 11 is shown mounted on the pump 10, in actual application valve assemblies 12 and 13 and the flow control 11 would be most likely contained in a single valve housing, or would be bolted together as sections of a sectional valve assembly. As shown in the drawing fixed or variable displacement pump 10 has inlet line 17, which supplies fluid to pump from the reservoir 16 and the pump 10 is driven through a shaft 18 by a prime mover not shown. The pump 10 has an outlet line 19 through which pressurized fluid is supplied to direction control valve assemblies 12 and 13.

The direction control valve 12 has a valve housing 20, which defines an inlet chamber 21 connected by outlet line 19 to the pump 10, transfer chambers 22 and 23 connected by a passage 24, load chambers 25 and 26 and exhaust chambers 27 and 28. Load chambers 25 and 26 are connected by lines 29 and 30 to the chambers of the actuator 14. Exhaust chambers 27 and 28 are connected with lines 31 and 32 with system reservoir 16. The valve housing 20 is provided with a bore 33 interconnecting exhaust chambers 27 and 28, load chambers 25 and 26, transfer chambers 22 and 23 and the inlet chamber 21 and axially guiding valve spool 34. The valve spool 34 has lands 35, 36, 37, 38 and 39, metering slots 40 and 41, unloading groove 42 with timing surfaces 43 and 44 and connecting slot 46. Land 36 of the valve spool 34 is provided with a conical surface **36*a*. The housing 20 is also provided with load sensing ports 47 and 48, unloading port 49 and cutoff surface 50. Load sensing ports 47 and 48 and unloading port 49 are connected through line 51, check valve 52 and signal line 53 with the flow control 11 of the pump 10. The flow control valve 13 is identical to flow control valve 12 with its valve spool 34 displaced to regenerative control position. The load sensing and unloading circuit of flow control valve 13 is connected through check valve 54 with signal line 53. The same components and features of control valve 13 are denoted by the same numbers as those of control valve 12**.

Control valve, generally designated as 12, is shown in its neutral position with lands of valve spool 34 blocking load chambers 25 and 26, the inlet chamber 21 and load sensing ports 47 and 48, while unloading groove 42 opens by timing surface 43 the unloading port 49 to the exhaust chamber 28, which is connected to the system reservoir 16. Therefore reservoir pressure is transmitted through line 51, check valve 52 and signal line 53 to the flow control 11. If a similar signal is transmitted from control valve 13, the flow control 11, in a well known manner, will maintain the pressure in outlet line 19 of the pump 10 at a minimum standby pressure level.

Assume that flow control valve 13 transmits from its load sensing circuit through check valve 54 to signal line 53 a zero pressure signal. Assume also that the valve spool 34 of flow control valve 12 was displaced in either direction from its neutral position. Initial displacement in either direction of the valve spool 34 will disconnect the unloading port 49 from the exhaust chamber 28. Upward movement of valve spool 34 will displace timing surface 43 past cutoff surface 50, isolating the unloading port 49, while by displacement of land 38 connecting the load chamber 26 with transfer chambers 22 and 23. Downward movement of valve spool 34, through displacement of timing surface 44, will isolate the unloading port 49, while by displacement of land 35 connecting the load chamber 25 with transfer chambers 22 and 23. Further displacement of the valve spool 34 in either direction will open load sensing port 47 or 48 to the transfer chamber 22 or 23, subjected to load pressure of load chamber 25 or 26, while land 37 still isolates the inlet chamber 21 from transfer chambers 22 and 23 and lands 35 and 38 still isolate load chamber 25 or 26 from exhaust chamber 27 or 28. Load pressure signal transmitted from load sensing port 47 or 48 to line 51 will open check valve 52, close check valve 54 and will react through signal line 53 on the flow control 11. The flow control 11, in a well known manner, will adjust the pressure in outlet line 19, to maintain a constant pressure differential between discharge pressure of the pump 10 and load signal pressure in signal line 53.

Still further displacement of the valve spool 34 will connect through metering slot 40 or 41 the inlet chamber 21 with transfer chambers 22 and 23, while simultaneously connecting one of the load chambers 25 or 26 to one of the exhaust chambers 27 or 28. Since a constant pressure differential is automatically maintained by the flow control 11 between the inlet chamber 21 and transfer chambers 22 and 23 connected to one of the load chambers 25 or 26, constant flow, proportional to the effective area of metering orifice 40 or 41 connected to the transfer chambers, will be delivered to load chamber 25 or 26. Since the flow from the inlet chamber 21 is proportional to the effective area of metering orifice it is also proportional to the displacement of the valve spool 34, thus controlling the velocity of the load $W_1$.

With the valve spool 34 of flow control valve 12 in neutral position and the valve spool 34 of flow control valve 13 moved upward all the way, as shown in the drawing, the flow control valve 13 is in a regeneration position. In this control position load chambers 25 and 26 are interconnected with each other through transfer chambers 22 and 23 and passage 24 and are also connected with inlet chamber 21, through a variable metering orifice 55, determined by the cross-sectional area of land 36 provided with a conical surface 36*a*. Land 36, shown conical in the drawing, in a well known manner, can be made of any desired shape and the size of metering orifice 55 can be varied by small adjustments in position of the valve spool 34. The connecting slot 46 conducts fluid pressure from interconnected load chambers to load pressure sensing port 47, from which it is transmitted through check valve 54 and signal line 53 to flow control 11. The pressure in load chambers 25 and 26 supports load $W_2$ and is equal to the quotient of load $W_2$ and the difference between the effective areas of actuator chambers 56 and 57. The pump 10, controlled by the flow control 11, will maintain in the inlet chamber 21 a pressure, higher by a constant pressure differential, than the pressure in load chambers 25 and 26. Therefore a constant pressure differential will be automatically maintained across orifice 55, resulting in a constant flow of fluid being delivered from the inlet chamber 20 to load chambers 25 and 26. The flow delivered from the pump 10 through orifice 55 to load chambers 25 and 26 will enter the actuator chamber 56 and will be supplemented by flow from the actuator chamber 57, proportionally increasing the velocity of load $W_2$. Since, irrespective of the variation in the load $W_2$, a constant flow, proportional to the effective area of the orifice 55, will be delivered from the pump 10 to load chambers 25 and 26, the load $W_2$ will be moving at an equivalent constant velocity, utilizing only part of the total delivery capacity of the pump 10. Therefore selection of area of orifice 55 will automatically determine the velocity of load $W_2$ during regeneration. The effective area of the orifice 55 can be varied by adjustment in the position of the valve spool 34.

Although the preferred embodiment of this invention has been shown and described in detail it is recognized that the invention is not limited to the precise form and structure shown and various modifications and rearrangements as will readily occur to those skilled in the art upon full comprehension of this invention may be resorted to without departing from the scope of the invention as defined in the claims.

What is claimed is:

1. A load responsive valve assembly comprising at least one valve housing having an inlet chamber, first and second load chambers, at least one exhaust chamber, and load sensing port means operable through signal conducting passage means to transmit a control load pressure signal to output flow control means of a pump, direction control means for selectively interconnecting and isolating said chambers and said load sensing port means in a number of control positions including a neutral position and a regeneration position, in said regeneration position said direction control means having means for interconnecting said first and second load chambers, means for interconnecting said first and second load chambers with said load sensing port means, means for interconnecting said first and second load chambers with said inlet chamber through variable metering orifice means and means operable to vary flow area of said variable metering orifice means.

2. A load responsive valve assembly as set forth in claim 1 wherein in said neutral position said direction control means includes blocking means operable to block said pressure sensing port means from said first and second load chambers and said inlet chamber, and connecting means operable to connect said pressure sensing port means to said exhaust chamber.

3. A load responsive valve assembly as set forth in claim 1 wherein check valve means in said signal conducting passage means is interposed for one way fluid flow between said load sensing port means and said output flow control of said pump.

4. A load responsive valve assembly as set forth in claim 1 wherein said means operable to vary flow area of said variable metering orifice means has means responsive to movement of said direction control means.

5. A load responsive valve assembly as set forth in claim 1 wherein said output flow control means of a pump includes pump displacement changing means.

6. A load responsive valve assembly as set forth in claim 1 wherein said output flow control means of a pump includes pump flow bypassing means.

* * * * *